US008193896B2

(12) United States Patent
Weinberg

(10) Patent No.: US 8,193,896 B2
(45) Date of Patent: Jun. 5, 2012

(54) POLYAMIDE ELECTRICAL INSULATION FOR USE IN LIQUID FILLED TRANSFORMERS

(76) Inventor: Martin Weinberg, New Canaan, CT (US)

( * ) Notice: Subject to any disclaimer, the term of this patent is extended or adjusted under 35 U.S.C. 154(b) by 61 days.

(21) Appl. No.: 12/583,101

(22) Filed: Aug. 15, 2009

(65) Prior Publication Data

US 2010/0039199 A1 Feb. 18, 2010

Related U.S. Application Data

(60) Provisional application No. 61/189,198, filed on Aug. 15, 2008, provisional application No. 61/189,199, filed on Aug. 15, 2008.

(51) Int. Cl.
*H01F 27/30* (2006.01)
*H01B 3/30* (2006.01)

(52) U.S. Cl. ..... 336/206; 336/209; 174/110 N

(58) Field of Classification Search ..... 336/205, 336/206, 209; 174/110 N, 137 R, 211; 525/425, 525/432, 436; 428/372, 379, 389
See application file for complete search history.

(56) References Cited

U.S. PATENT DOCUMENTS

| | | | | | |
|---|---|---|---|---|---|
| 2,130,523 | A * | 9/1938 | Carothers | 528/335 |
| 2,278,350 | A * | 3/1942 | Graves | 524/83 |
| 2,333,922 | A * | 11/1943 | Foster | 428/379 |
| 2,456,717 | A * | 12/1948 | Lowden | 524/46 |
| 2,705,227 | A * | 3/1955 | Stamatoff | 523/307 |
| 2,991,326 | A * | 7/1961 | Ford et al. | 174/17 R |
| 3,841,959 | A * | 10/1974 | Mertens | 442/117 |
| 4,342,814 | A * | 8/1982 | Usuki et al. | 428/383 |
| 4,420,536 | A * | 12/1983 | Saunders et al. | 428/383 |
| 4,616,053 | A * | 10/1986 | Schultz et al. | 524/171 |
| 4,624,718 | A * | 11/1986 | Hessler et al. | 156/56 |
| 5,296,558 | A * | 3/1994 | Hood et al. | 525/425 |
| 5,350,794 | A * | 9/1994 | Herron et al. | 524/496 |
| 5,487,856 | A * | 1/1996 | Saraf | 264/78 |
| 6,087,591 | A * | 7/2000 | Nguyen et al. | 174/110 R |
| 6,231,979 | B1 * | 5/2001 | Nagamine et al. | 428/379 |
| 6,525,272 | B2 * | 2/2003 | Higashiura et al. | 174/120 R |
| 2010/0230133 | A1 * | 9/2010 | Saito et al. | 174/120 C |

* cited by examiner

*Primary Examiner* — Anh Mai
*Assistant Examiner* — Joselito Baisa

(57) ABSTRACT

An aliphatic polyamide film or fibrous material is employed for electrical insulation in individual conductors, groups of conductors, magnet wire, magnet wire coils, and layers in liquid filled electrical transformers. The material is stabilized with additives that produce improved moisture resistance, moisture stability, thermal stability, thermal conductivity, reduced insulation thickness, reduced shrinkage, and improved insulation elasticity for the insulation material thereby providing a longer useful life for the material.

18 Claims, 2 Drawing Sheets

POLYAMIDE ELECTRICAL INSULATION FOR USE IN LIQUID FILLED TRANSFORMERS

CROSS REFERENCE TO RELATED APPLICATIONS

This application claims the benefit of U.S. Ser. No. 61/189,198, filed Aug. 15, 2008 and U.S. Ser. No. 61/189,199, filed Aug. 15, 2008.

TECHNICAL FIELD

This invention relates to a thermoplastic film or fibrous material containing an aliphatic polyamide and/or one or more copolymers and/or additives thereof; to electrical components that are insulated by this material; and to the method of forming those components. More particularly, this invention relates to an aliphatic polyamide film or fibrous material for electrical insulation in individual conductors, groups of conductors, and layers in liquid filled electrical transformers, which material produces improved moisture resistance, moisture stability, thermal stability, thermal conductivity, reduced insulation thickness, reduced shrinkage, and improved insulation elasticity.

BACKGROUND ART

The current standard insulating materials in liquid filled transformers are cellulosic materials of various thicknesses and density. Cellulose-based insulating materials, commonly called Kraft papers, have been widely used in oil-filled electrical distribution equipment since the early 1900's. Despite some of the shortcomings of cellulose, Kraft paper continues to be the insulation of choice in virtually all oil-filled transformers because of its low cost and reasonably good performance. Unfortunately, the cellulose polymer is subject to thermal degradation and vulnerable to oxidative and hydrolytic attack.

In general, cellulose-based insulating materials are used to insulate five different parts of the internal structure of the transformer. They consist mainly of: (1) turn-to-turn insulation of magnet wires; (2) layer-to-layer insulation; (3) low-voltage coil-to-ground insulation; (4) high-voltage coil-to-low voltage coil insulation; and (5) high-voltage coil-to-ground insulation.

The low-voltage coil-to-ground and the high-to-low voltage coil insulations usually consist of solid tubes combined with liquid filled spaces. The purpose of these spaces is to remove the heat from the core and coil structure through convection of the medium, and also help to improve the insulation strengths. The internal turn insulation is generally placed directly on the rectangular magnet wires and wrapped as paper tape. The material that is chosen to insulate the layer-to-layer, coil-to-coil and coil-to-ground insulation is according to the insulating requirements. These materials may vary from Kraft paper that is used in smaller transformers, whereas relatively thick spacers made of heavy cellulose press board, cellulose paper or porcelain are used for higher rating transformers.

The following are areas of importance describing the current art.

Moisture

The presence of moisture in a transformer deteriorates cellulosic transformer insulation by decreasing both the electrical and mechanical strength. In general, the mechanical life of the insulation is reduced by half for each doubling in water content, the rate of thermal deterioration of the paper is proportional to its water content. The importance of moisture presence in paper and oil systems has been recognized since the 1920s.

The electrical quality of cellulosic material is highly dependent on its moisture content. For most applications, a maximum initial moisture content of 0.5% is regarded as acceptable. In order to achieve this moisture level the cellulosic material has to be processed under heat and vacuum to remove the moisture before oil impregnation. The complete removal of moisture from cellulosic insulation without causing chemical degradation is a practical impossibility. Determination of the ultimate limit to which cellulose can be safely heated for the purposes of dehydrating without affecting its mechanical and electrical properties continues to be a major problem for transformer designers and manufacturers.

When exposed to air, cellulose absorbs moisture from the air quite rapidly. If not immediately impregnated with oil, equilibrium with the moisture content of the air is reached in a relatively short time. The moisture absorption process is considerably slowed after the cellulose has been oil impregnated.

After being saturated with oil in the transformer, the cellulosic insulation is further exposed to moisture in the oil and will continue to absorb available moisture. This is partly is also due to the absorption of water from the surrounding air into the oil. This resulting further moisture absorption causes problems in the cellulosic insulation, increasing aging rate and degrading electrical qualities. Cellulose has a strong affinity for water (hygroscopic) and thus will not share the moisture equally with the insulating liquid. This hygroscopic nature of cellulose insulation constitutes an ever present difficulty both in the manufacture and maintenance of transformers which are so insulated.

The presence of moisture increases the aging rate. Insulating paper with a one percent moisture content ages about six times faster than one with only 0.3 percent. Therefore attempts to substantially reduce these objectionable changes due to the presence of moisture in the solid insulation have been the motivation of a substantial engineering effort for many decades.

Further, as cellulose ages, the chains of glucose rings in the molecules break up and release carbon monoxide, carbon dioxide, and water. The water attaches to impurities in the oil and reduces oil quality, especially dielectric strength. Small amounts of moisture even microscopic amounts accelerate deterioration of cellulose insulation. Studies show more rapid degradation in the strength of cellulose with increasing amount of moisture even in the absence of oxidation.

Shrinkage

Cellulosic transformer material has to be processed under heat and vacuum to remove the moisture before oil impregnation. Cellulosic material shrinks when moisture is removed. It also compresses when subjected to pressure. Therefore, it is necessary to dry and precompress the cellulosic insulation to dimensionally stabilize windings before adjusting them to the desired size during the transformer assembly process.

Thermal Conductivity

Existence of localized hot regions (HST or Hot Spot Temperature) in the transformer due to thermal insulating properties of electrical insulation would cause thermal runaway around these regions if not for the overall system conductivity drawing excess heat away. It must be adequately dissipated to prevent excessive heat accumulation leading to the destruction of the transformer. Inordinate localized temperature rise causes rapid thermal degradation of insulation and subsequent electrical breakdown.

Chemical Stability

Oxidation can be controlled but not eliminated. Oxygen comes from the atmosphere or is liberated from the cellulose as a result of heat. Oxidation of the cellulose is accelerated by the presence of certain oil decay products called polar compounds, such as acids, peroxides and water. The first decay products, peroxides and water soluble and highly volatile acids, are immediately adsorbed by the cellulose insulation up to its saturation level. In the presence of oxygen and water, these "seeds of destruction" give a potent destructive effect on the cellulosic structure. The acids of low molecular weight are most intensively adsorbed by the cellulosic insulation in the initial period, and later, the rate of this process slows down. The oxidation reaction may attack the cellulose molecule in one or more of its molecular linkages. The end result of such chemical change is the development of more polar groups and the formation of still more water. The most common form of oxidation contamination introduces acid groups into the solid or liquid insulation. The acids brought on by oxidation split the polymer chains (small molecules bonded together) in the cellulosic insulation, resulting in a decrease of tensile strength. It also embrittles the cellulosic insulation.

Thermal Degradation

A significant percent of cellulosic deterioration is thermal in origin. Elevated temperature accelerates aging causing reduction in the mechanical and dielectric strength. Secondary effects include paper decomposition (DP or depolymerization), and production of water, acidic materials, and gases. If any water remains where it is generated, it further accelerates the aging process. Heating results in severing of the linkage bonds within the cellulose (glucose) molecules, resulting in breaking down of the molecules, causing the formation of water. This resulting water causes continuous new molecular fission, and weakens the hydrogen bonds of the molecular chains of pulp fibers.

Reduced Winding Compactness

Transformer heat additionally creates two problems: embrittlement of cellulosic material; and shrinkage of cellulose. This results in a loose transformer structure which is free to move under impulse, or through fault, resulting in damage to the insulation.

Withstanding Bending Forces of Conductor Insulation

A current use of cellulosic papers, with a 15-20% machine direction elongation results in conductor insulation which is less damaged by bending or twisting in coil manufacture. The current papers however have a cross directional elongation of less than 5%. This presents limitations for the transformer manufacturer in optimizing insulated wire bends and may not permit use of this material as a linear applied insulation.

It would be desirable to have an improved electrical insulating material that overcomes the above short comings of the presently used cellulosic electrical insulation. It would be desirable to have an insulation material that is not adversely affected by moisture and that does not require drying as an initial manufacturing step.

DISCLOSURE OF THE INVENTION

An electrical insulating material made wholly or in part of aliphatic polyamide and/or one or more copolymers and/or additives thereof can be used in a film form or in a fibrous form as an insulator in liquid filled transformers. The film or fiber will contain a thermal/chemical stabilizer such as those broadly described in U.S. Pat. Nos. 2,705,227; 3,519,595; and 4,172,069. The term "polyamide" describes a family of polymers which are characterized by the presence of amide groups.

Many technically used synthetic polyamides are derived from monomers containing 6-12 carbon atoms; most prevalent are PA6 and PA66. The amide groups in the mostly semi crystalline polyamides are capable of forming strong electrostatic forces between the —NH and the —CO— units (hydrogen bonds), producing high melting points, exceptional strength and stiffness, high barrier properties and excellent chemical resistance. Moreover, the amide units also form strong interactions with water, causing the polyamides to absorb water. These water molecules are inserted into the hydrogen bonds, loosening the intermolecular attracting forces and acting as a plasticizer, resulting in the exceptional toughness and elasticity.

Moisture

The subject electrical insulation of this invention, upon exposure to moisture, shows an increase in toughness and elongation. Long term exposure to moisture produces no negative aging effects. The subject material will absorb moisture, removing it from the surrounding oil, which may be a positive effect.

Shrinkage and Reduced Winding Compactness

As the subject material does not need to be dried before use, it does not have the initial shrinkage issues of the current art. Further, exposure to elevated transformer temperatures and moisture will not cause embrittlement. The transformer will not be subject to problems of reduced winding compactness. Additionally, due to the high tensile strength and elongation memory of the subject material, turn insulation will remain tightly wrapped to the conductor wire. In addition, the stress-induced crystallinity of the film embodiment of the invention will provide improved long term dimensional stability.

Thermal Conductivity

The subject material film embodiment of the invention has a K factor (standard of thermal conductance=W/(m·K)) of 0.25. Oil impregnated cellulosic material has a K factor of approximately 0.10 (based on 50% oil saturation). Further, the subject material has a dielectric strength approximately 2× that of oil impregnated cellulosic insulation of equal thickness, requiring approximately half the thickness in turn insulation for the same electrical insulation characteristics. This would yield a minimum 4× improvement in turn-to-turn thermal conductivity, a significant improvement in overall system conductivity. Use of the film embodiment of this invention will result in reduced requirements for designing for the "worst case" thermal stress of insulating paper in the hot spot of winding during the overload condition.

Thermal Degradation and Oxidative Stability

The subject aliphatic polyamide insulating material will contain one or more thermal/chemical stabilizers, such as, but not limited to, copper halide, copper bromide, copper iodide, copper acetate, calcium bromide, lithium bromide, zinc bromide, magnesium bromide, potassium bromide and potassium iodide, to name a few. These compounds provide significant thermal and chemical stability beyond the long term requirements of the current transformer designs, as will be pointed out in greater detail hereinafter. They may enable designers to run transformers at higher temperatures and provide longer operating life than the currently used cellulose insulations. Selected mixtures of these additives are present in the polymer mixture in a range of about 0.1 to about 10% by weight, and preferably about 2% by weight.

Withstanding Bending Forces of Conductor Insulation

The subject aliphatic polyamide film insulation material, if manufactured with stress induced crystallinity in the machine direction, will have mechanical properties that are ideal for turn (conductor) insulation, i.e., very high machine direction tensile strength; a very high machine direction elongation with elastic memory; and with a very high level of cross directional elongation (over 100%) which provides more versatility to the linear and spiral wrap types of insulation. These features enable very high speed conductor wrapping with a snug coverage on the magnet wire that will remain tight regardless of subsequent bending or twisting. The film version of the insulation material may be subject to stress induced crystallinity in the machine direction by stretching and elongating sheets of the aliphatic polymer film complex.

The subject tensile strength, elongation, thermal conductivity and heat transfer coefficient characteristics of the aliphatic polyamide insulation material of this invention and cellulose insulation material were compared with the following observed results.

| | Elongation Retention as a % of the original value | | Tensile Strength Retention as a % of the original value | |
|---|---|---|---|---|
| Exposure (hrs) | Unstabilized PA 66 | Stabilized PA 66 | Unstabilized PA 66 | Stabilized PA 66 |
| 0 | 100 | 100 | 100 | 100 |
| 240 | 4 | 112 | 35 | 101 |
| 500 | 3 | 114 | 26 | 103 |
| 1,000 | 3 | 114 | 23 | 102 |
| 2,000 | 2 | 90 | 17 | 106 |

It will be noted that the elongation retention and the tensile strength retention properties of the stabilized aliphatic polyamide insulation material in this invention by far out performs the unstabilized aliphatic polyamide insulating material when subjected to high temperatures in air in an oven. Surprisingly, the tensile strength of the polyamide insulation actually increases in the high temperature oven environment.

Objects, features and advantages of the present invention will become more apparent from the following detailed description of exemplary embodiments thereof, as illustrated in the accompanying drawings.

BRIEF DESCRIPTION OF THE DRAWINGS

The invention will be more readily understood from the following detailed description of preferred embodiments thereof when taken in conjunction with the accompanying drawings wherein.

| Properties | | Method | Unit | Poly Insul. | Paper Insul. |
|---|---|---|---|---|---|
| Tensile Strength (MD) | Original (as received) | TAPPI T494 | lbs/in | 45.2 | 42 |
| | In Transformer Oil (no aging) | " | " | 48.3 | 20.1 |
| | In Oil (after in aging in oil 29 days @160° C.) | " | " | 53.5 | 12.5 |
| Elongation (MD) | Original (as received) | TAPPI T494 | % | 21.0 | 20.0 |
| | In Transformer Oil (no aging) | " | " | 28.3 | 8.0 |
| | In Oil (after in aging in oil 29 days @160° C.) | " | " | 19.9 | 1.1 |
| Thermal Conductivity | In Oil (after in aging in oil 29 days @160° C.) K Value Crepe = 80% paper + 20% oil Heat Transfer Coefficient = K/L (L is thickness) Crepe = 80% | ASTM D5470 | W/(m-K) | 0.250 | 0.070 |
| | In Oil (after in aging in oil 29 days @160° C.) K Value Crepe = 80% paper + 20% oil | ASTM D5470 | $W * K^{-1} * m^2$ | 0.167 | 0.023 |

It will be noted that the various properties of the aliphatic polyamide insulation material by far out performs the current day cellulose insulating material. Surprisingly, the tensile strength of the polyamide insulation actually increases in the high temperature oil filled environment.

The tensile strength and elongation properties of the aliphatic polyamide insulation material of this invention and a convention aliphatic polyamide insulation material were also compared after oven aging in air with the following observed results.

DETAILED DESCRIPTION OF THE INVENTION

Figure 1:
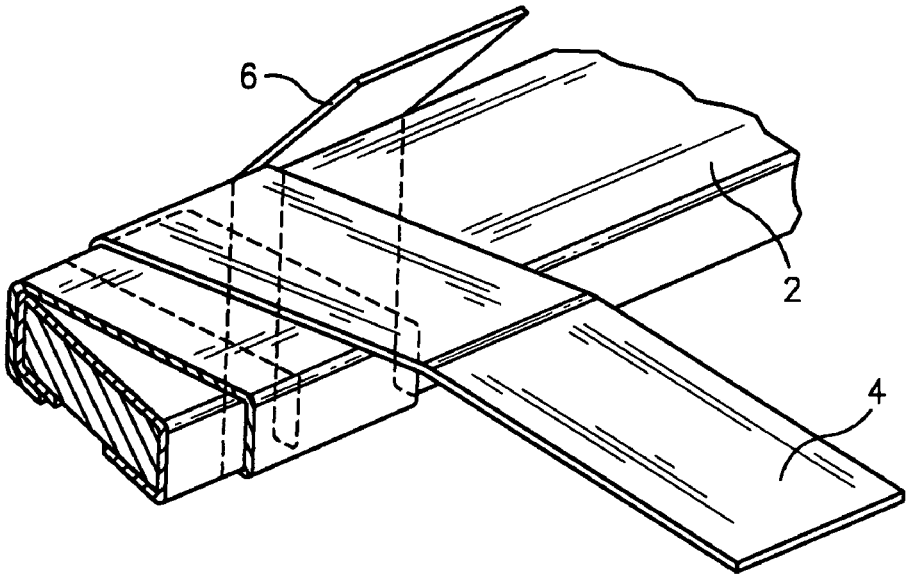
FIG. 1 is a fragmented perspective view of a spiral wrapped electrical magnet wire which is formed in accordance with this invention and which is used in the windings of an oil filled transformer.
Figure 2:
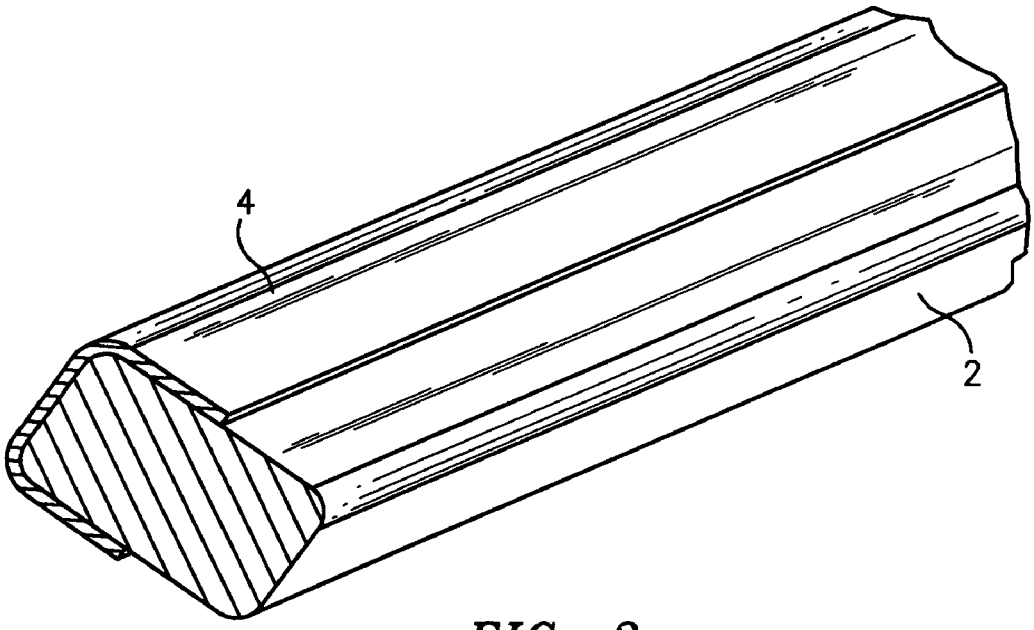
FIG. 2 is a perspective view similar to FIG. 1, but showing a linear wrapped electrical magnet wire which is formed in accordance with this invention and which is used in the windings of an oil filled transformer.

Referring now to the drawings, FIGS. 1 and 2 show two different forms of insulated magnet wire 2 that can be used for oil filled transformer coils. These magnet wires are insulated with aliphatic polyamide insulation tapes 4 and 6 which are formed in accordance with this invention. FIG. 1 shows a spirally wrapped magnet wire 2 wherein the insulation tapes 4 and 6 are spirally wrapped about the magnet wire 2 in a known manner. FIG. 2 shows a linear wrapped magnet wire 2 that can be used for oil filled transformer coils. These magnet wires are also insulated with aliphatic polyamide insulation tape 4 which is formed in accordance with this invention.

Figure 3:
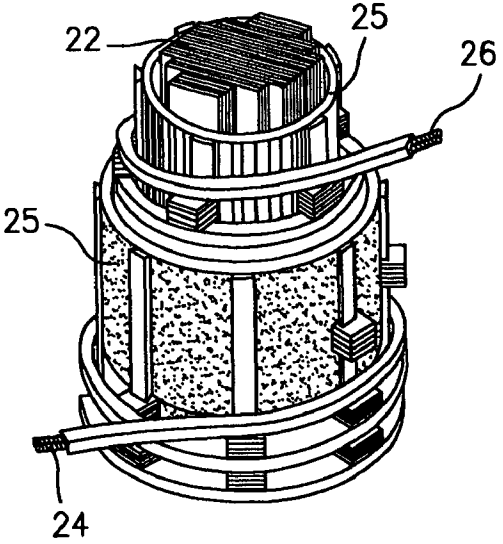
FIG. 3 is a fragmented perspective view of a transformer which is formed in accordance with this invention.

FIG. 3 is a fragmented perspective view of a transformer assembly which is suitable for use in an oil filled power system. The transformer assembly includes a core component 22, a low voltage winding coil 26 and a high voltage winding coil 24. The coils are formed from the insulated magnet wire 2 shown in FIGS. 1 and 2. Insulation tubes 25 are interposed between the core 22 and the low voltage winding coil 26, and between the low voltage winding coil 26 and the high voltage winding coil 24. These insulation tubes 25 are formed from the stabilized aliphatic polyamide insulation material of this invention.

Figure 4:
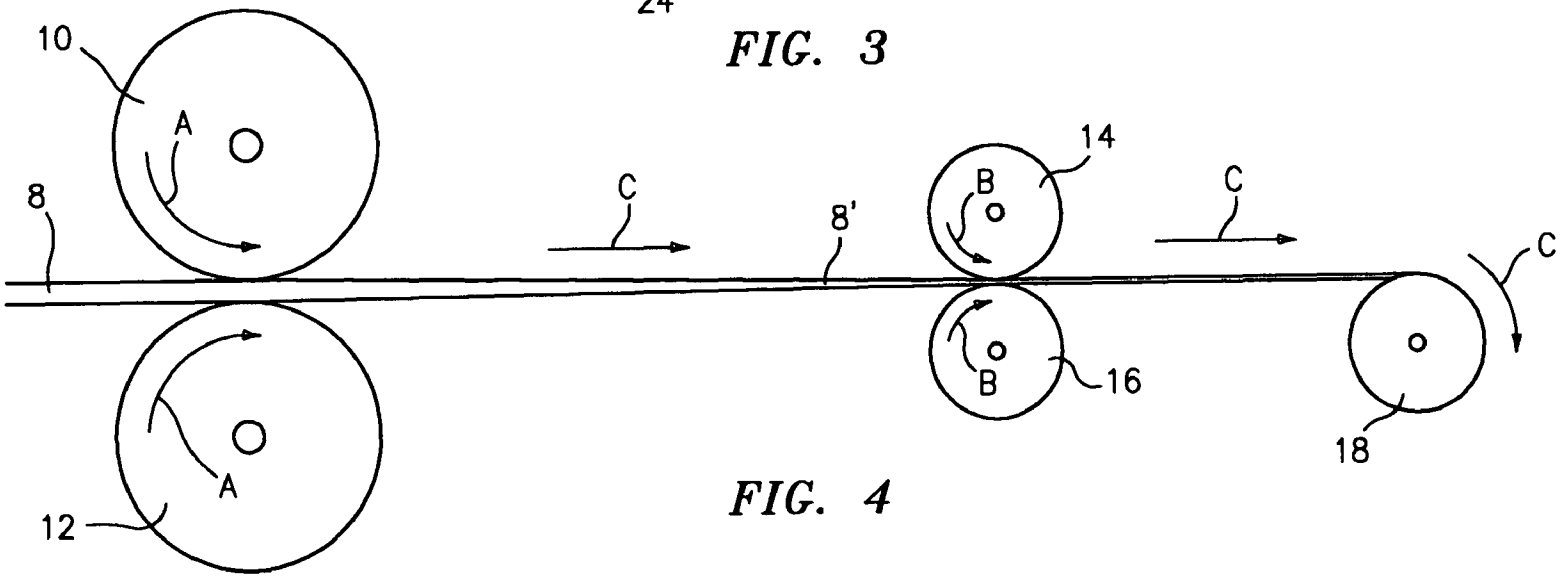
FIG. 4 is a schematic view of an assembly which is used to longitudinally stretch or elongate the film embodiment of the aliphatic polyamide insulation so as to induce crystallization of the film.

FIG. 4 is a schematic view of an assembly which can be used to axially elongate and stretch the insulation material when it is in the film form. The assembly includes a pair of heated rollers 10 and 12 through which the aliphatic polyamide film sheet 8 is fed. The rollers 10 and 12 rotate in the direction A at a first predetermined speed and are operative to heat the film sheet 8 and compress it. The heated and thinned sheet 8 is then fed through a second set of rollers 14 and 16 which rotate in the direction B at a second predetermined speed which is greater than the first predetermined speed, so as to stretch the film in the direction C to produce a thinner crystallized film sheet 8' which is then fed in the direction C onto a pickup roller 8 where it is wound into a roll of the crystallized aliphatic polyamide film sheet which can then be slit into insulation strips if so desired.

The fibrous form of the insulating material is formed in the following manner. The enhanced stabilized molten polymer resin is extruded through spinnerettes in a plurality of threads onto a moving support sheet whereupon the threads become entangled on the support sheet to form spun bonded sheets of the extruded material. These spun bonded sheets of insulation material are then compressed into sheets of insulation. Preferably, the sheets are then further processed by placing a plurality of them one atop another and then they are once again passed through rollers which further compress and bond them so as to form the final sheets of the aliphatic polyamide insulating material in a fibrous form. This fibrous form of the insulating material contains one of the thermal/chemical stabilizing compounds described above.

In order to enhance the insulation factor of the insulation of this invention, the fibrous embodiment of the insulation of this invention may be bonded to the film embodiment of the insulation of this invention to form a compound embodiment of an insulating material formed in accordance with this invention.

It will be readily appreciated that the aliphatic polyamide electrical insulating material of this invention will improve and stabilize oil filled transformers markedly. The insulating material of this invention clearly outperforms the current cellulose transformer insulating material in every important property.

Since many changes and variations of the disclosed embodiment of the invention may be made without departing from the inventive concept, it is not intended to limit the invention except as required by the appended claims.

What is claimed is:

1. A transformer assembly comprising electrical conductor coils, which assembly is insulated with an aliphatic polyamide insulation tape, which tape contains stabilizing compounds that function as a means for providing increased thermal and chemical stability for the insulation tape when the transformer assembly is operated in an oil-filled environment.

2. The transformer assembly of claim 1 wherein said stabilizing compounds are selected from the group consisting of copper halide, copper bromide, copper iodide, copper acetate, calcium bromide, lithium bromide, zinc bromide, magnesium bromide, potassium bromide and potassium iodide and mixtures thereof.

3. The transformer assembly of claim 2 wherein selected mixtures of said stabilizing compounds are present in an amount which is in the range of about 0.1% to about 10.0% by weight of the insulation tape.

4. The transformer assembly of claim 1 wherein said film insulation material is at least partially crystallized by being axially stretched.

5. The transformer assembly of claim 1 wherein said insulation tape is formed from aliphatic polyamide fibers.

6. A magnet wire which is insulated with an aliphatic polyamide insulation tape, which tape incorporates compounds that provide increased thermal and chemical stability for the insulation tape when the magnet wire is used in an oil-filled transformer.

7. The magnet wire of claim 6 wherein said stabilizing compounds are selected from the group consisting of copper halide, copper bromide, copper iodide, copper acetate, calcium bromide, lithium bromide, zinc bromide, magnesium bromide, potassium bromide and potassium iodide and mixtures thereof.

8. The magnet wire of claim 7 wherein selected mixtures of said stabilizing compounds are present in an amount which is in the range of about 0.1% to about 10.0% by weight of the insulation tape.

9. The magnet wire of claim 6 wherein said film insulation tape is at least partially crystallized by being axially stretched.

10. The magnet wire of claim 6 wherein said insulation tape is composed of aliphatic polyamide fibers.

11. A high temperature liquid transformer magnet wire coil, said coil being insulated with an aliphatic polyamide insulation tape, which tape incorporates compounds that provide increased thermal and chemical stability for the insulation tape when the magnet wire coil is immersed in an oil-filled transformer.

12. The magnet wire coil of claim 11 wherein said stabilizing compounds are selected from the group consisting of copper halide, copper bromide, copper iodide, copper acetate, calcium bromide, lithium bromide, zinc bromide, magnesium bromide, potassium bromide and potassium iodide, and mixtures thereof.

13. The magnet wire coil of claim 12 wherein selected mixtures of said stabilizing compounds constitute an amount which is in the range of about 0.1% to about 10.0% by weight of the insulation tape.

14. The magnet wire coil of claim 11 wherein said film insulation tape is at least partially crystallized by being axially stretched.

15. The magnet wire coil of claim 11 wherein said insulation tape is formed from aliphatic polyamide fibers.

16. An electrical insulation tape for insulating magnet wire which is used in coils for oil filled transformers, said insulation tape being formed of an aliphatic polyamide material into which thermal and chemical stability compounds are incorporated.

17. The insulation tape of claim 16 wherein said insulation tape is at least partially crystallized by being axially stretched.

18. A magnet wire which is insulated with an insulation tape consisting essentially of aliphatic polyamide, which tape has a thermal stability value and a chemical stability value, which tape incorporates one or more stabilizing compounds adapted to increase one or both of the thermal and chemical stability values of the insulation tape when the insulation tape is disposed in an oil-filled transformer.

* * * * *